US008058581B2

(12) United States Patent
Chen

(10) Patent No.: US 8,058,581 B2
(45) Date of Patent: Nov. 15, 2011

(54) ROTARY CONTROL SWITCH MOUNTED ON CONTROL PANEL OF ELECTRICAL APPLIANCE

(75) Inventor: Hung-Wei Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 318 days.

(21) Appl. No.: 12/540,247

(22) Filed: Aug. 12, 2009

(65) Prior Publication Data

US 2010/0140064 A1 Jun. 10, 2010

(30) Foreign Application Priority Data

Dec. 4, 2008 (TW) ..... 97147074 A
Jun. 24, 2009 (TW) ..... 98121259 A

(51) Int. Cl.
*H01H 13/62* (2006.01)

(52) U.S. Cl. ..... 200/565

(58) Field of Classification Search ..... 200/38 R, 200/4, 6 R, 11 R–11 K, 564–571, 336
See application file for complete search history.

(56) References Cited

U.S. PATENT DOCUMENTS 7,423,230 B2 * 9/2008 Yoritsune et al. ..... 200/565
7,476,822 B2 * 1/2009 Miura et al. ..... 200/564
7,767,916 B2 * 8/2010 Kurihara et al. ..... 200/38 R

* cited by examiner

*Primary Examiner* — Edwin A. Leon
(74) *Attorney, Agent, or Firm* — Kirton & McConkie; Evan R. Witt

(57) ABSTRACT

A rotary control switch includes a body member, a shaft member and a conducting member. The body member includes a main body having a receptacle and a perforation. Multiple recesses are disposed within the receptacle. The perforation is communicated with the receptacle. The shaft member includes a base and a rotating shaft. The base has a sustaining structure. A protrusion is extended from the rotating shaft. The conducting member is connected with the base of the shaft member. The protrusion is sustained against or engaged with the main body and the base is accommodated within the receptacle of the body member. The base of the shaft member is rotated with respect to the control panel and the body member upon rotation of the rotating shaft. When the sustaining structure is sustained against a specified one of the recesses, the conducting member is electrically connected with a corresponding contact pad of the control panel.

22 Claims, 17 Drawing Sheets

ROTARY CONTROL SWITCH MOUNTED ON CONTROL PANEL OF ELECTRICAL APPLIANCE

FIELD OF THE INVENTION

The present invention relates to a rotary control switch, and more particularly to a rotary control switch mounted on a control panel of an electrical appliance. The present invention relates to a control panel having such a rotary control switch.

BACKGROUND OF THE INVENTION

Generally, an electrical appliance such as a washing machine has a control panel with one or more control switches. By operating the control switches, desired operating conditions of the electrical appliance are adjusted. FIG. 1 is a schematic view illustrating a control panel and some rotary control switches of a washing machine according to the prior art. As shown in FIG. 1, the control panel 2 of the washing machine 1 is a circuit board. Several rotary control switches 20 are mounted on the control panel 2. For clarification, three rotary control switches 20*a*, 20*b* and 20*c* are shown in the drawings and the upper cover for sheltering the control panel 2 is exempted. By rotating the rotary control switches 20*a*, 20*b* and 20*c*, desired operating conditions (e.g. the motor's speed) of the electrical appliance are adjusted.

FIG. 2A is a schematic exploded view illustrating a rotary control switch of the control panel as shown in FIG. 1. Take the rotary control switch 20*a* for example. As shown in FIG. 2A, the rotary control switch 20*a* includes a body member 21, a shaft member 22 and a conducting member 23. FIG. 2B is a schematic rear view illustrating the body member of the rotary control switch of FIG. 2A. Please refer to FIGS. 2A and 2B. A receptacle 210 is defined at the rear side of the body member 21. The receptacle 210 includes a first receiving part 2101 and a second receiving part 2102. Several recesses 211 are formed in the sidewall of the first receiving part 2101. The bulk of the second receiving part 2102 is greater than that of the first receiving part 2101. The body member 21 further includes a perforation 212 and several posts 213. The perforation 212 runs through the body member 21 and is communicated with the receptacle 210. The posts 213 are vertically extended from the bottom surface of the body member 21 for facilitating fixing the rotary control switch 20*a* on the control panel (as shown in FIG. 1).

The shaft member 22 includes a base 220 and a rotating shaft 221. The base 220 includes a first base segment 2201 and a second base segment 2202. The first base segment 2201 is disposed on the second base segment 2202. In addition, a receiving hole 222 is formed in an outer periphery of the first base segment 2201 for receiving therein a sustaining structure 225 that is collectively defined by a resilient element 223 and a sustaining element 224. The rotating shaft 221 is extended vertically and upwardly from the first base segment 2201 such that the rotating shaft 221 is perpendicular to the receiving hole 222.

The conducting member 23 is substantially a metallic plate with several pins 230 and several apertures 231. The apertures 231 are aligned with corresponding protrusions (not shown) on the bottom surface of the second base segment 2202 of the base 220. After the protrusions are inserted into the apertures 231, the conducting member 23 may be fixed on the bottom surface of the second base segment 2202 of the base 220. After the rotating shaft 221 is penetrated through the perforation 212 of the body member 21, the first base segment 2201 and the second base segment 2202 are respectively accommodated within the first receiving part 2101 and the second receiving part 2102 of the receptacle 210 of the body member 21. At the same time, the sustaining structure 225 that is perpendicular to the rotating shaft 221 is sustained against a recess 211 in the sidewall of the first receiving part 2101. After the posts 213 of the body member 21 are inserted into corresponding insertion holes 24 of the control panel 2, the rotary control switch 20*a* is fixed on the control panel 2 (as shown in FIG. 1).

Please refer to FIG. 1 again. The control panel 2 has several conducting regions 25. For example, corresponding to the rotary control switches 20*a*, 20*b* and 20*c*, the control panel 2 has three conducting regions 25*a*, 25*b* and 25*c*, respectively. Take the conducting region 25*a* for example. The conducting region 25*a* has several contact pads 250. The contact pads 250 include a first conducting piece 251 and several second conducting pieces 252 that enclose the first conducting piece 251. The insertion holes 24 are disposed in the vicinity of the conducting region 25*a*. After the rotary control switch 20*a* is fixed on the control panel 2 by inserting the posts 213 of the body member 21 into corresponding insertion holes 24 of the control panel 2, the rotary control switch 20*a* is mounted over the conducting region 25*a*. Meanwhile, the pins 230 of the conducting member 23, which are attached on the bottom surface of the second base segment 2202 of the shaft member 22, are contacted with corresponding contact pads 250. When an external force is exerted on the rotating shaft 221 of the rotary control switch 20*a*, the base 220 is rotated with the rotating shaft 221. As the base 220 is rotated from a first position to a second position, the sustaining structure 225 is disengaged from a first recess 211 and then engaged with a second recess 211. In addition, the pins 230 of the conducting member 23 are contacted with other contact pads 250. Under this circumstance, an operating condition (e.g. a motor's speed) of the washing machine 1 is selected. The relation between the rotary control switch 20*b* and the conducting region 25*b* and the relation between the rotary control switch 20*c* and the conducting region 25*c* are similar to the relation between the rotary control switch 20*a* and the conducting region 25*a*.

The conventional rotary control switch 20, however, still has some drawbacks. For combining the shaft member 22 with the body member 21, a sharp tool is required to manually push the sustaining structure 225 toward the receiving hole 222 in order to successfully accommodate the first base segment 2201 of the base 220 within the first receiving part 2101 of the receptacle 210, because the sustaining structure 225 is laterally protruded from the first base segment 2201 of the base 220. In addition, for mounting the combination of the body member 21 and the shaft member 22 on the control panel 2, a plastic tube 26 is sheathed around the body member 21 and the shaft member 22 to temporarily combine the body member 21 and the shaft member 22 together. The use of the plastic tube 26 increases extra cost. Moreover, for overcoming a short-circuit problem of the conducting member 23 or the control panel 2, a waterproof glue is usually applied on the junction between the rotary control switch 20 and the control panel 2 to prevent moist gas or vapor gas from entering the rotary control switch 20. In other words, the process of assembling the conventional rotary control switch 20 is very troublesome and complicated.

Moreover, the rotary control switches 20*a*, 20*b* and 20*c* need to be respectively mounted on the conducting regions 25*a*, 25*b* and 25*c*. The circuitry layout of the conducting regions 25*a*, 25*b* and 25*c* are different. If a rotary control switch is erroneously mounted on the proper conducting region, the user fails to control the operating conditions of the washing machine 1 by using the rotary control switch 20 and the control panel 2. Moreover, since a large-area body member 21 is used for facilitating firmly fixing the rotary control switch 20 on the control panel 2, the space utilization of the control panel 2 is limited.

There is a need of a providing an improved rotary control switch to obviate the drawbacks encountered from the prior art.

SUMMARY OF THE INVENTION

It is an object of the present invention to provide a rotary control switch mounted on a control panel of an electrical appliance, in which the rotary control switch is assembled in a simplified manner.

In accordance with an aspect of the present invention, there is provided a rotary control switch mounted on a control panel of an electrical appliance. The rotary control switch includes a body member, a shaft member and a conducting member. The body member includes a main body having a receptacle and a perforation. Multiple recesses are disposed within the receptacle. The perforation is communicated with the receptacle. The shaft member includes a base and a rotating shaft. The base is aligned with the receptacle of the body member. The base has a sustaining structure. A protrusion is extended from the rotating shaft. The conducting member is connected with the base of the shaft member. After the rotating shaft of the shaft member is penetrated through the perforation of the body member and protruded from the body member, the protrusion is sustained against or engaged with the main body and the base is accommodated within the receptacle of the body member. The main body of the body member is disposed on the control panel. The base of the shaft member is rotated with respect to the control panel and the body member upon rotation of the rotating shaft. When the sustaining structure is sustained against a specified one of the recesses, the conducting member is electrically connected with a corresponding contact pad of the control panel.

In accordance with another aspect of the present invention, there is provided a control panel of an electrical appliance. The control panel includes a conducting region and a rotary control switch. The conducting region has multiple contact pads. The rotary control switch is mounted on the conducting region. The rotary control switch includes a body member, a shaft member and a conducting member. The body member includes a main body having a receptacle and a perforation. Multiple recesses are disposed within the receptacle. The perforation is communicated with the receptacle. The shaft member includes a base and a rotating shaft. The base is aligned with the receptacle of the body member. The base has a sustaining structure. A protrusion is extended from the rotating shaft. The conducting member is connected with the base of the shaft member. After the rotating shaft of the shaft member is penetrated through the perforation of the body member and protruded from the body member, the protrusion is sustained against or engaged with the main body and the base is accommodated within the receptacle of the body member. The main body of the body member is disposed on the conducting region. The base of the shaft member is rotated with respect to the conducting region and the body member upon rotation of the rotating shaft. When the sustaining structure is sustained against a specified one of the recesses, the conducting member is electrically connected with a corresponding contact pad of the conducting region.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The control panel and the rotary control switch of the present invention can be applied to various electrical appliances such as washing machine or fans. In particular, the rotary control switch is a potentiometer. The use of a potentiometer to control the operating condition of the electrical appliance is within the concept of the present invention.

Figure 1:
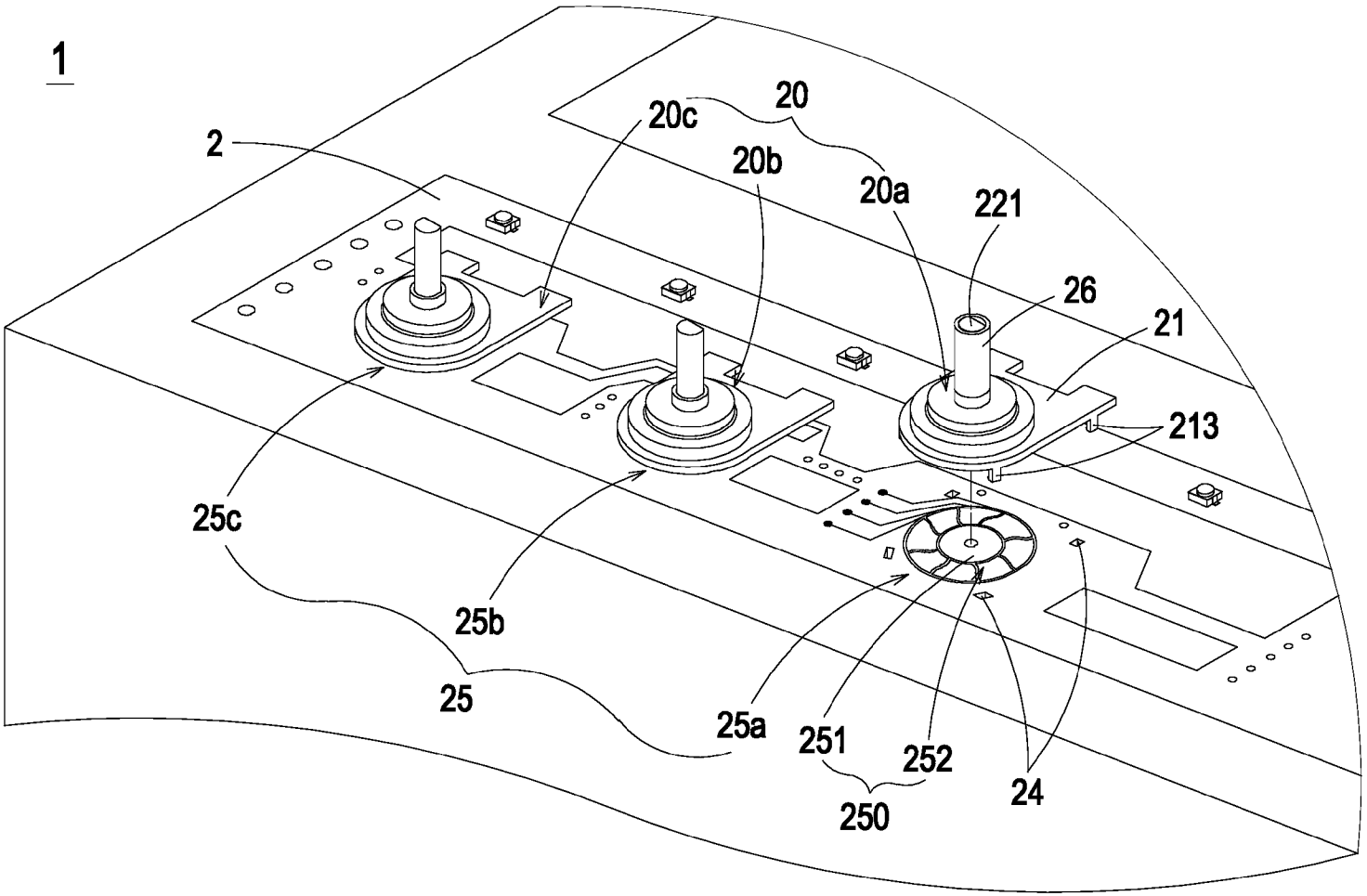
FIG. 1 PRIOR ART
FIG. 1 is a schematic view illustrating a control panel and some rotary control switches of a washing machine according to the prior art.
Figure 2A:
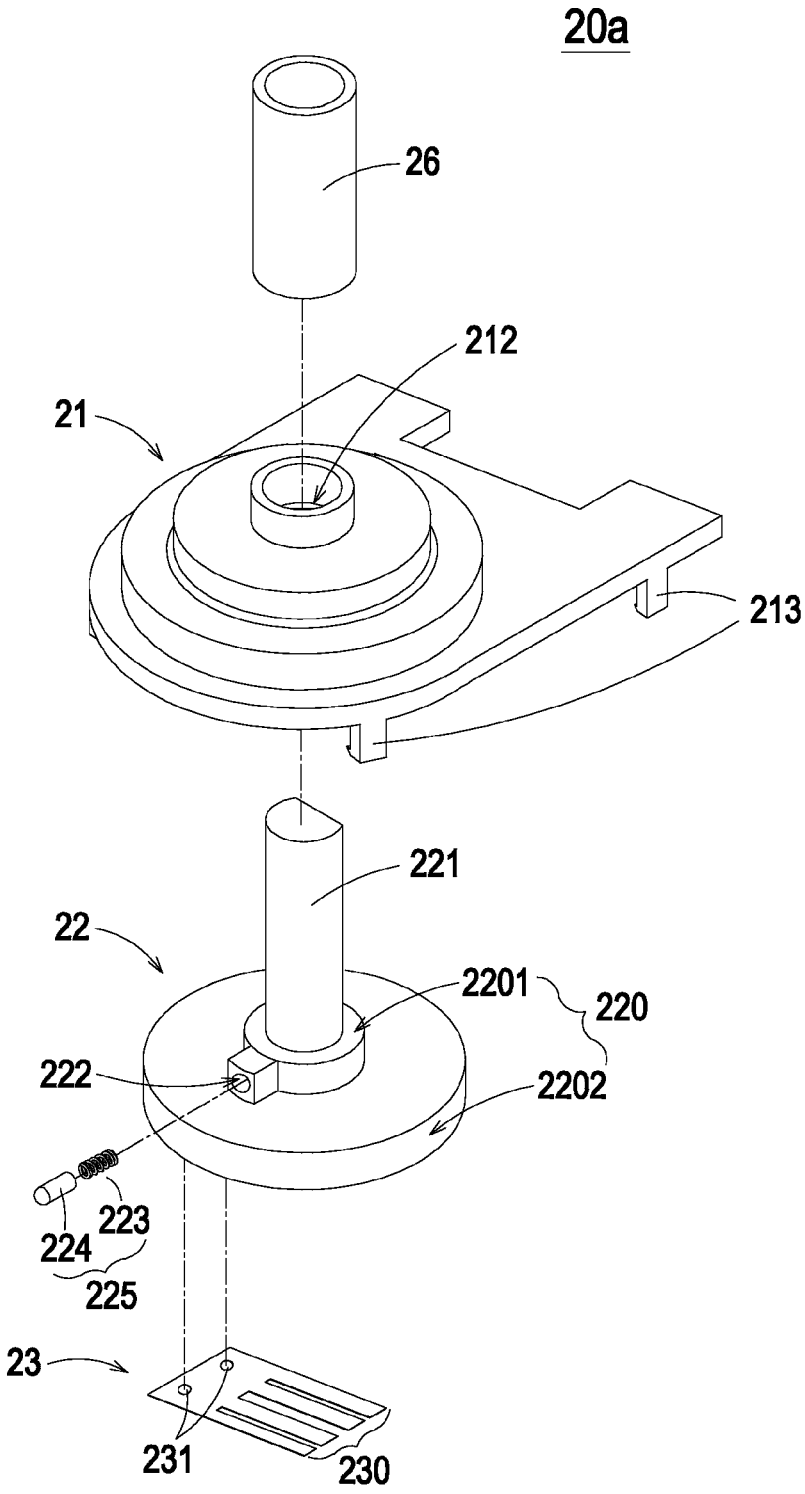
FIG. 2A PRIOR ART
FIG. 2A is a schematic exploded view illustrating a rotary control switch of the control panel as shown in FIG. 1.
Figure 2B:
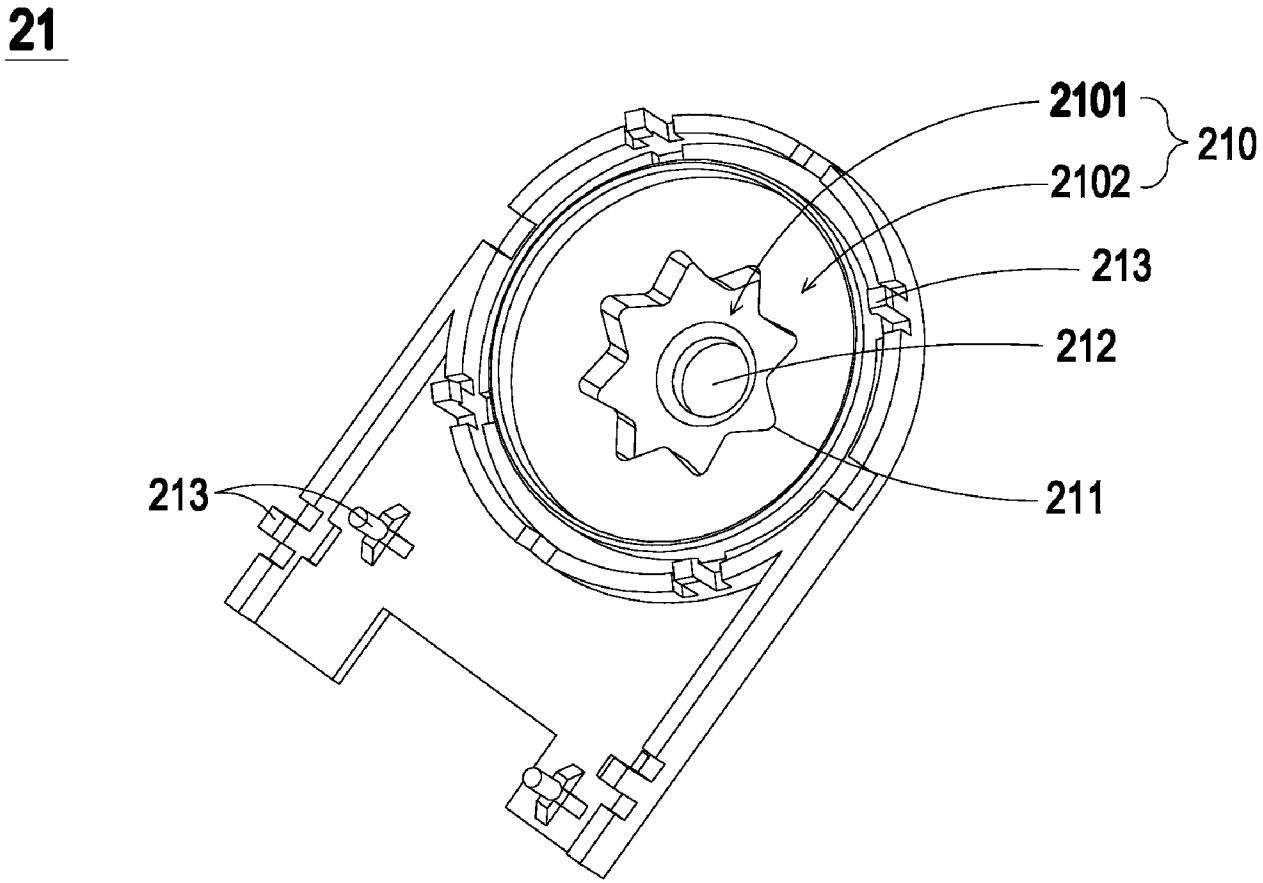
FIG. 2B PRIOR ART
FIG. 2B is a schematic rear view illustrating the body member of the rotary control switch of FIG. 2A.
Figure 3:
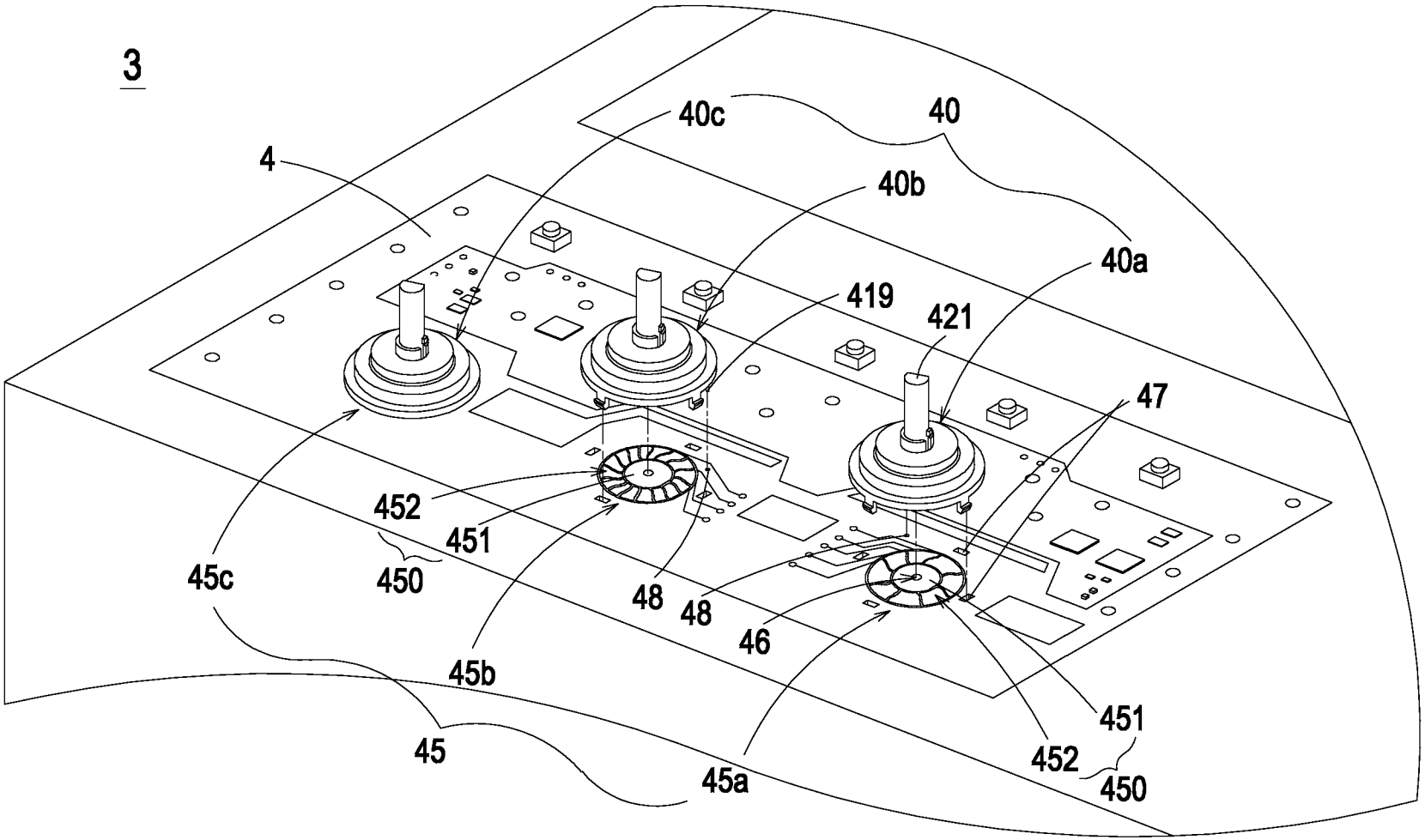
FIG. 3 is a schematic view illustrating a control panel and some rotary control switches of an electrical appliance according to a first embodiment of the present invention.

FIG. 3 is a schematic view illustrating a control panel and some rotary control switches of an electrical appliance according to a first embodiment of the present invention. An example of the electrical appliance 3 includes but is not limited to a washing machine. The control panel 4 of the washing machine 3 is a circuit board. At least one rotary control switch 40 is mounted on at least one conducting region 45 of the control panel 4. For clarification, three rotary control switches 40*a*, 40*b* and 40*c* are shown in the drawings and the upper cover for sheltering the control panel 4 is exempted. Corresponding to the rotary control switches 40*a*, 40*b* and 40*c*, the control panel 4 has three conducting regions 45*a*, 45*b* and 45*c*. It is noted that the number of the numbers of the rotary control switches 40 and the conducting regions 45 may be varied according to the practical requirements. By rotating the rotary control switches 40, desired operating conditions (e.g. the motor's speed) of the washing machine 3 are adjusted. Hereinafter, the configurations of the first rotary control switch 40*a* and the first conducting region 45*a* will be illustrated for best understanding the present invention.

Figure 4A:
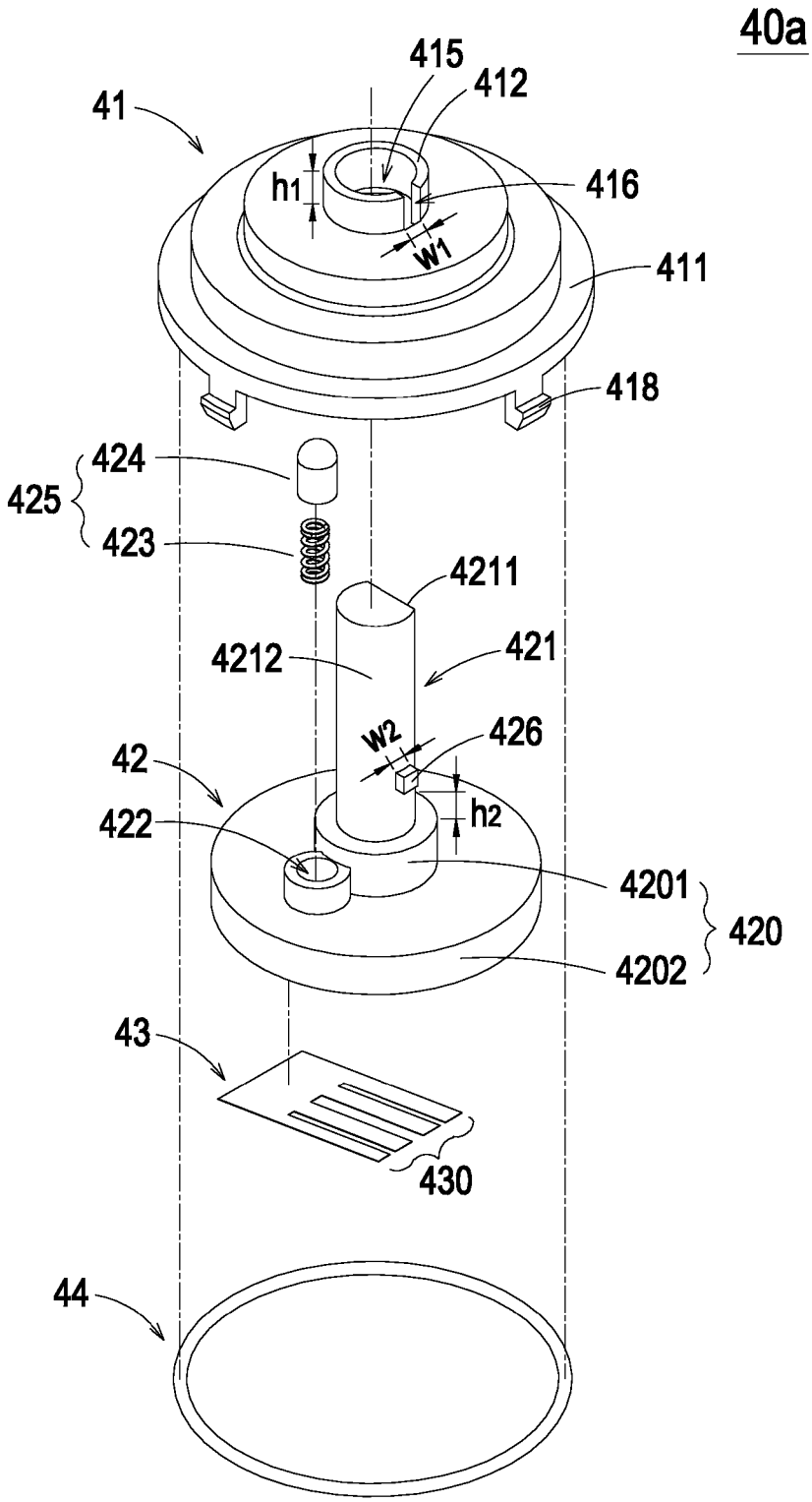
FIG. 4A is a schematic exploded view illustrating the first rotary control switch of the control panel as shown in FIG. 3.
Figure 4B:
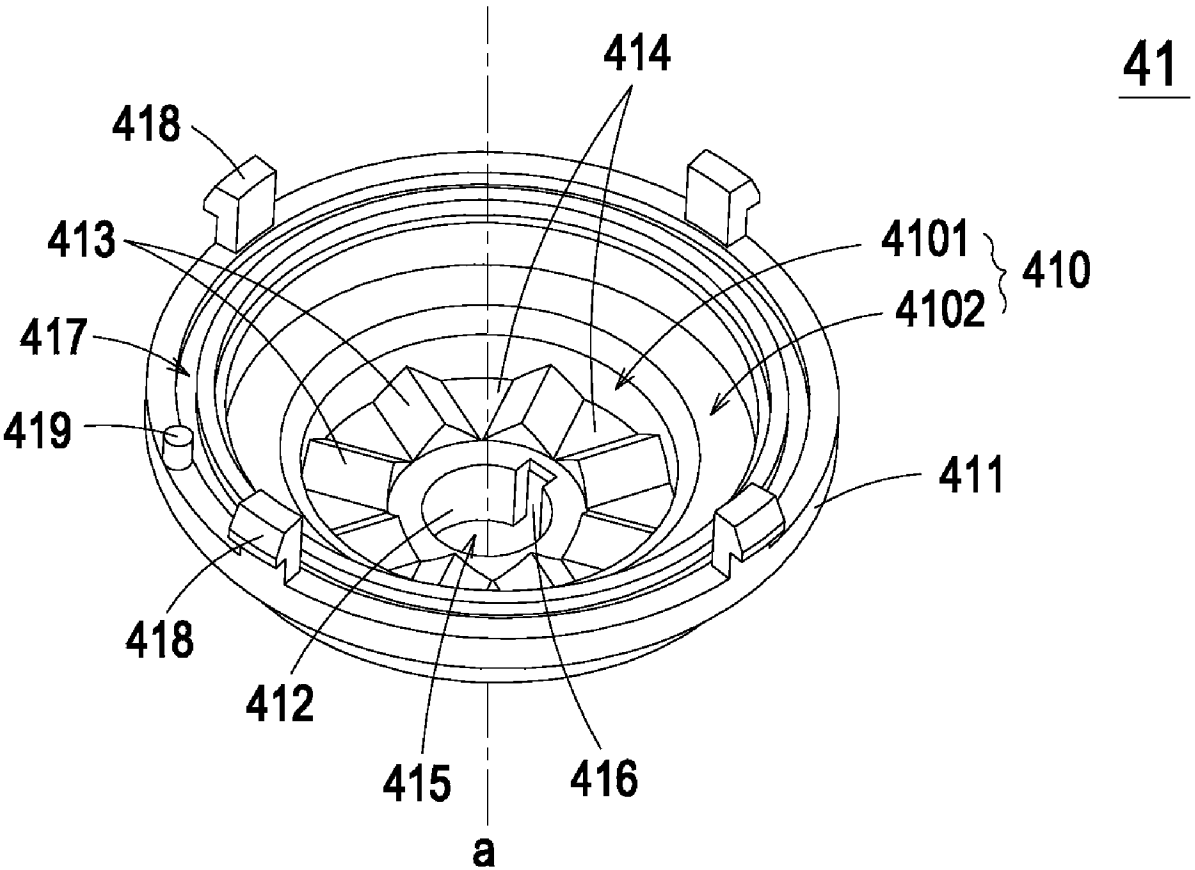
FIG. 4B is a schematic rear view illustrating the body member of the first rotary control switch of FIG. 4A.

FIG. 4A is a schematic exploded view illustrating the first rotary control switch of the control panel as shown in FIG. 3. Take the first rotary control switch 40*a* for example. As shown in FIG. 4A, the rotary control switch 40*a* includes a body member 41, a shaft member 42, a conducting member 43 and a seal ring 44. FIG. 4B is a schematic rear view illustrating the body member of the first rotary control switch of FIG. 4A. Please refer to FIGS. 4A and 4B. The body member 41 includes a disc-shaped main body 411. A receptacle 410 is defined at the rear side of the body member 41. The body member 41 further includes a perforation 415. The perforation 415 runs through the body member 41 and is communicated with the receptacle 410. The receptacle 410 is concavely formed in the bottom surface of the main body 411. The receptacle 410 includes a first receiving part 4101 and a second receiving part 4102. The first receiving part 4101 and the second receiving part 4102 are cylindrical space and coaxial with the axle center "a" of the main body 411. The first receiving part 4101 is arranged above the second receiving part 4102. The bulk of the second receiving part 4102 is greater than that of the first receiving part 4101 (as shown in FIG. 4D). Several ribs 413 are formed in the receptacle 410. The ribs 413 are discretely arranged on the top surface of the first receiving part 4101 of the receptacle 410 at regular intervals such that every two adjacent ribs 413 collectively define a recess 414. In this embodiment, eight ribs 413 and eight recesses 414 are formed in the receptacle 410. In particular, eight ribs 413 and eight recesses 414 are alternately arranged on the top surface of the first receiving part 4101 of the receptacle 410. It is noted that the number of the numbers of the ribs 413 and the eight recesses 414 may be varied according to the practical requirements.

The main body 411 of the body member 41 further includes a sleeve 412, which has a height h1 and is protruded from the top surface of the main body 411 along the axle center "a" (as shown in FIG. 4A). In other words, the receptacle 410 is concavely formed in the bottom surface of the main body 411 and the sleeve 412 is vertically protruded from the top surface of the main body 411. The perforation 415 is coaxial with the sleeve 412 along the axle center "a". The diameter of the perforation 415 is substantially identical to the inner diameter of the sleeve 412. The sleeve 412 is communicated with the receptacle 410 through the perforation 415. In addition, the sleeve 412 has a notch 416 along the axle center "a". The notch 416 has a width w1.

Please refer to FIGS. 4A and 4B again. In the bottom side of the main body 411, a groove 417, several engaging elements 418 and a positioning element 419 are provided. The groove 417 is formed in the bottom surface of the main body 411 for accommodating the seal ring 44. The thickness of the seal ring 44 is slightly greater than the depth of the groove 417. The seal ring 44 is made of rubbery material or other material. Any waterproof or elastic material is applicable to make the seal ring 44. The engaging elements 418 of the body member 41 are extended from the bottom surface of the main body 411. In this embodiment, the engaging elements 418 include multiple hooks, which are discretely arranged at regular intervals. After the engaging elements 418 are engaged with corresponding engaging holes 47 of the control panel 4, the first rotary control switch 40*a* is fixed on the control panel 4 (as shown in FIG. 3). The positioning element 419 is also downwardly extended from the bottom surface of the main body 411. The positioning element 419 is for example a post for facilitating the first rotary control switch 40*a* to be precisely mounted on the first conducting region 45*a* of the control panel 4 in a foolproof manner. It is preferred that all components of the body member 41 are integrally formed into a one-piece element.

Please refer to FIG. 4A again. The shaft member 42 includes a base 420, a rotating shaft 421, a receiving hole 422, a sustaining structure 425 and a protrusion 426. The base 420 is aligned with the receptacle 410 of the body member 41. The base 420 includes a first base segment 4201 and a second base segment 4202. The first base segment 4201 and the second base segment 4202 are cylindrical and coaxial with each other. The first base segment 4201 is disposed on the second base segment 4202. The diameter of the first base segment 4201 is smaller than that of the second base segment 4202. The diameter of the first base segment 4201 is also smaller than the inner diameter of the first receiving part 4101 of the body member 41. The height of the first base segment 4201 is substantially identical to the depth of the first receiving part 4101. The diameter and the height of the second base segment 4202 are substantially to those of the second receiving part 4102 of the body member 41.

Figure 4C:
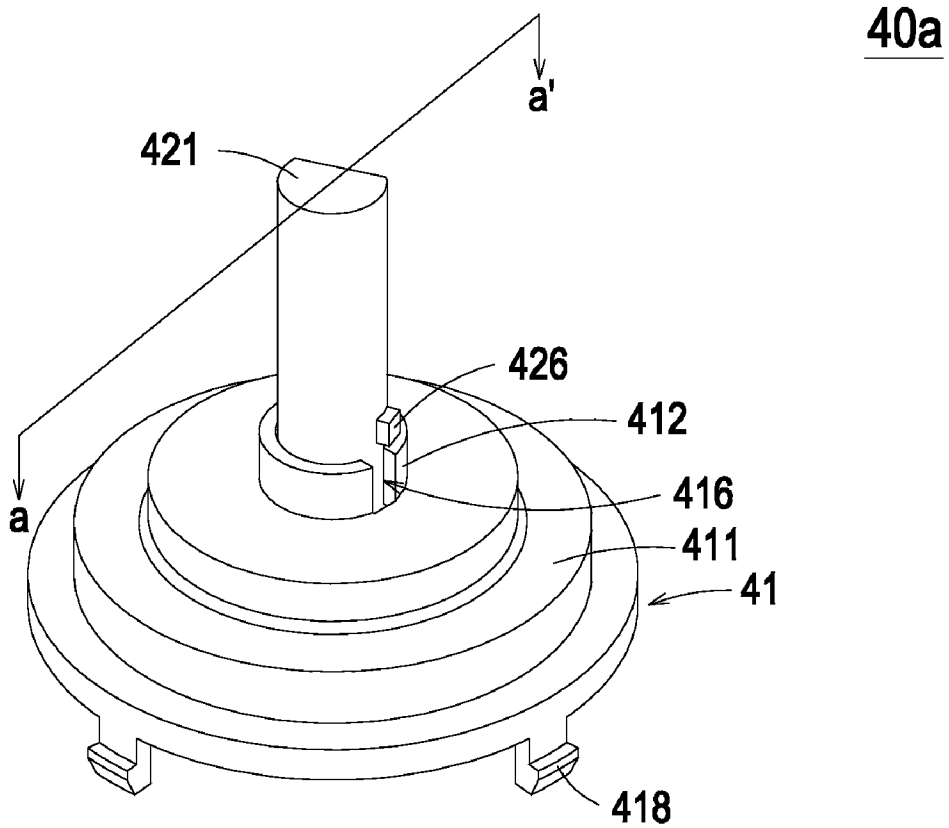
FIG. 4C is a schematic assembled view of the first rotary control switch as shown in FIG. 4A.
Figure 4D:
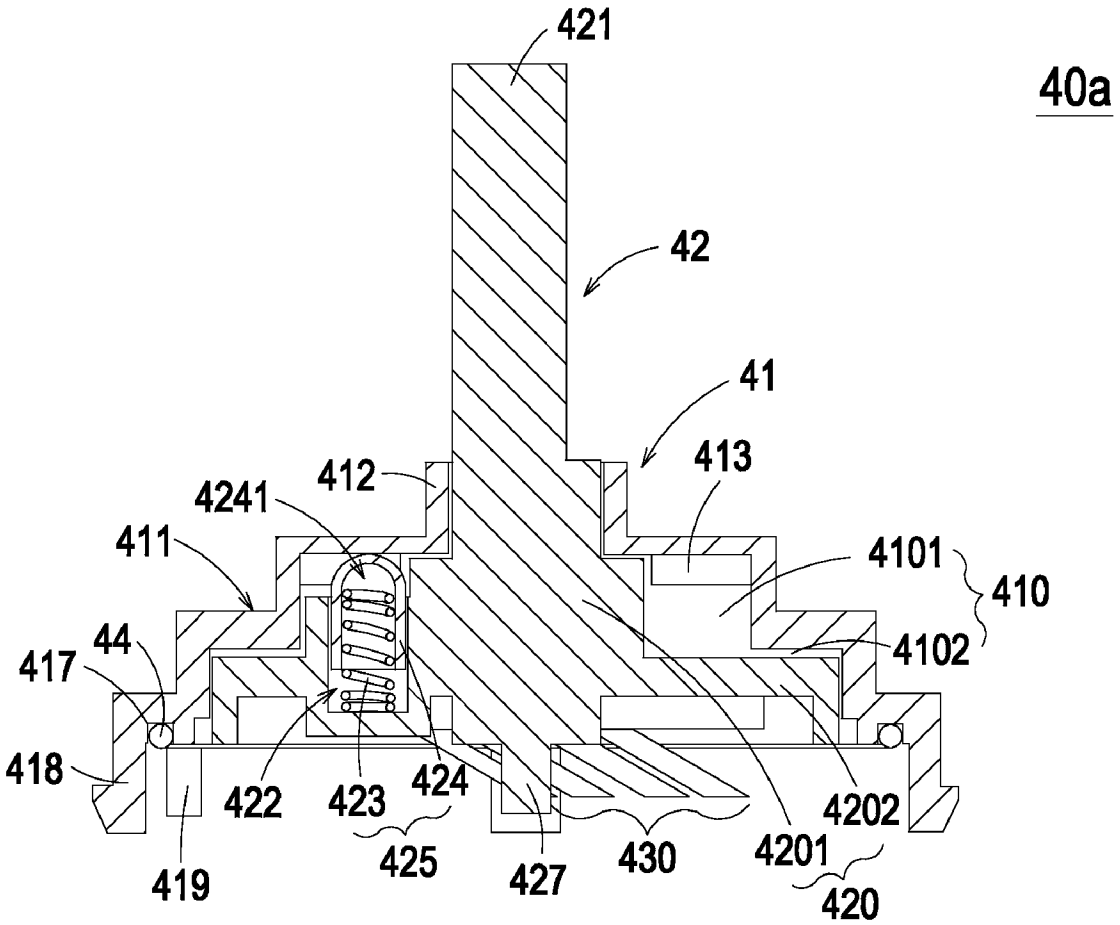
FIG. 4D is a schematic cross-sectional view of the first rotary control switch taken along the line a-a'.

FIG. 4C is a schematic assembled view of the first rotary control switch as shown in FIG. 4A. FIG. 4D is a schematic cross-sectional view of the first rotary control switch taken along the line a-a'. As shown in FIGS. 4C and 4D, the first base segment 4201 is accommodated within the first receiving part 4101 and in the vicinity of the perforation 415 and the ribs 413. The second base segment 4202 is accommodated within the second receiving part 4102 of the body member 41.

The rotating shaft 421 is extended vertically and upwardly from the first base segment 4201 and aligned with the perforation 415 of the body member 41. The height of the rotating shaft 421 is greater than the height h1 of the sleeve 412. As shown in FIG. 4A, the rotating shaft 421 is substantially a semi-cylindrical solid including a cutting plane 4211 and a curved surface 4212. The curved surface 4212 mates with the profiles of the perforation 415 and the sleeve 412 of the body member 41. The cutting plane 4211 is a good force-exerting point for facilitating the user to rotate the rotating shaft 421. In addition, as shown in FIG. 4D, an axle post 427 is protruded from the bottom surface of the second base segment 4202.

The receiving hole 422 is formed in the base 420 of the rotating shaft 421 for receiving therein the sustaining structure 425 that is collectively defined by a resilient element 423 and a sustaining element 424. In this embodiment, the rotating shaft 421 has one receiving hole 422. Alternatively, the rotating shaft 421 may have more receiving holes 422. The receiving hole 422 is circular in shape. In addition, the receiving hole 422 is parallel with the extending direction of the rotating shaft 421. An example of the resilient element 423 is a spring. The resilient element 423 is partially accommodated in an indentation 4241 of the sustaining element 424 (as shown in FIG. 4D). The sustaining element 424 mates with the receiving hole 422. In particular, the sustaining element 424 is a hollow cylinder with an arch-shaped upper end. The sustaining element 424 is preferably made of metallic material. The protrusion 426 is formed on the curved surface 4212 of the rotating shaft 421. The protrusion 426 has a width w2. The protrusion 426 is distant from the first base segment 4201 by a gap h2. The protrusion 426 is substantially a cubic solid. In this embodiment, the components of the shaft member 42 excluding the sustaining structure 425 are integrally formed into a one-piece element.

Please refer to FIG. 4A again. The conducting member 43 is substantially a metallic plate with several pins 430. In an embodiment, the conducting member 43 is a copper plate with four pins 430. It is preferred that the pins 430 are integrally formed with the metallic plate.

Please refer to FIGS. 4A, 4B, 4C and 4D. After the first rotary control switch 40*a* is assembled, the seal ring 44 is accommodated within the groove 417, which is formed in the bottom surface of the main body 411. Since thickness of the seal ring 44 is slightly greater than the depth of the groove 417, the seal ring 44 is slightly protruded outside the groove 417 after the seal ring 44 is accommodated within the groove 417. The conducting member 43 is fixed on the bottom surface of the second base segment 4202 by for example an adhering, fastening or welding means (see FIG. 4D). After the resilient element 423 of the sustaining structure 425 is partially accommodated in the indentation 4241 of the sustaining element 424, the combination of the sustaining element 424 and the resilient element 423 is partially accommodated within the receiving hole 422 of the base 420 (see FIG. 4D). In other words, after the resilient element 423 is sheathed by the sustaining element 424, an elastic force is exerted on the sustaining element 424 such that the sustaining structure 425 is slightly protruded outside the receiving hole 422. Since the receiving hole 422 is parallel with the rotating shaft 421, the sustaining structure 425 is parallel with the rotating shaft 421.

After the sustaining structure 425 is accommodated within the receiving hole 422, the rotating shaft 421 of the shaft member 42 is penetrated through the perforation 415 such that the sleeve 412 is sheathed around the rotating shaft 421. Since the height of the rotating shaft 421 is greater than the height h1 of the sleeve 412, the rotating shaft 421 is protruded from the body member 41. Since the width w2 of the protrusion 426 is slightly smaller than the width w1 of the notch 416, the protrusion 426 can be moved along the notch 416 during the rotating shaft 421 is penetrated through the perforation 415. As such, the first base segment 4201 and the second base segment 4202 of the shaft member 42 are respectively accommodated within the first receiving part 4101 and the second receiving part 4102 of the body member 41. At the same time, the sustaining structure 425 is engaged with any recess 414. In addition, the gap h2 between the protrusion 426 and the first base segment 4201 is slightly greater than the height h1 of the sleeve 412. By rotating the rotating shaft 421 with respect to the body member 41 such that the protrusion 426 is no longer aligned with the notch 416 of the sleeve 412, the protrusion 426 is sustained against the sleeve 412 of the main body 411. That is, the elastic force exerted on the top surface of the receptacle 410 by the sustaining structure 425 is balanced when the protrusion 426 and the sleeve 412 are sustained against each other. Under this circumstance, the shaft member 42 and the body member 41 are securely combined together and the base 420 of the shaft member 42 is smoothly accommodated within the receptacle 410 of the body member 41.

As previously described in the prior art, a plastic tube 26 is sheathed around the body member 21 and the shaft member 22 to temporarily combine the body member 21 and the shaft member 22 together. The use of the plastic tube 26 increases extra cost. Whereas, since the protrusion 426 is sustained against the sleeve 412 of the main body 411 according to the present invention, the body member 41 and the shaft member 42 are securely combined together without the need of using the plastic tube 26. Since the ribs 413 and the recesses 414 are alternately arranged on the top surface of the receptacle 410 and the sustaining structure 425 is arranged along the extending direction of the rotating shaft 421, the sustaining structure 425 slightly protruded outside the receiving hole 422 will no longer obstruct from assembling the body member 41 and the shaft member 42. For combining the body member 41 and the shaft member 42 together, if a tiny force is exerted on the bottom surface of the second base segment 4202 of the base 420 or the rotating shaft 421 penetrating the perforation 415 is pulled, the elastic force exerted on the top surface of the receptacle 410 by the sustaining structure 425 is balanced so as to smoothly accommodate the base 420 within the receptacle 410. As previously described in the prior art, a sharp tool is required to manually push the sustaining structure 225 toward the receiving hole 222 in order to successfully accommodate the first base segment 2201 of the base 220 within the first receiving part 2101 of the receptacle 210. According to the present invention, the procedure of using the sharp tool is omitted and thus the process of assembling the rotary control switch is simplified.

The first rotary control switch 40*a* of FIG. 4C may be mounted on the first conducting region 45*a* of the control panel 4. Please refer to FIG. 3 again. The first conducting region 45*a* of the control panel 4 has several contact pads 450. The contact pads 450 include a first conducting piece 451 and several second conducting pieces 452. The first conducting piece 451 is a circular conducting piece. The second conducting pieces 452 are discretely arranged around the periphery of the first conducting piece 451 at regular intervals. The first conducting piece 451 and the second conducting pieces 452 are made of metallic material. The first conducting piece 451 and the second conducting pieces 452 are electrically connected to the trace patterns on the control panel 4. The number of the second conducting pieces 452 is equal to the number of the recesses 414 of the body member 41 of the first rotary control switch 40*a*. In this embodiment, the first conducting region 45*a* has eight second conducting pieces 452. In addition, the first conducting piece 451 of the first conducting region 45*a* has a center hole 46, which is aligned with the axle post 427 of the first rotary control switch 40*a*. Corresponding to the engaging elements 418, several engaging holes 47 are formed in the vicinity of the first conducting region 45*a* of the control panel 4. In addition, corresponding to the positioning element 419, a positioning hole 48 is formed in the vicinity of the first conducting region 45*a* of the control panel 4.

For mounting the first rotary control switch 40*a* on the first conducting region 45*a* of the control panel 4, the engaging elements 418 are engaged with corresponding engaging holes 47 of the control panel 4 to fix the first rotary control switch 40*a*. In a case that the engaging elements 418 are hooks, the first rotary control switch 40*a* is more securely fixed on the first conducting region 45*a* of the control panel 4. Moreover, during the first rotary control switch 40*a* is mounted on the first conducting region 45*a*, the positioning element 419 of the body member 41 is inserted into the positioning hole 48 in order to facilitate alignment of the body member 41 on the control panel 4. In addition, the axle post 427 of the first rotary control switch 40*a* is inserted into the center hole 46 of the first conducting region 45*a*.

After the first rotary control switch 40*a* is mounted on the first conducting region 45*a*, the base 420 of the shaft member 42 is clamped between the body member 41 and the control panel 4. After the axle post 427 of the first rotary control switch 40*a* is inserted into the center hole 46 of the first conducting region 45*a*, the possibility of rocking the shaft member 42 with respect to the control panel 4 is minimized. Since the sustaining structure 425 is slightly protruded outside the receiving hole 422 and the conducting member 43 is disposed on the bottom surface of the second base segment 4202 of the base 420, the sustaining element 424 is sustained against any recess 414 due to the elastic force of the elastic element 423 and the conducting member 43 is properly contacted with the contact pads 450 of the first conducting region 45*a*. In this embodiment, the two pins 430 adjacent to the axle post 427 are contacted with the first conducting piece 451 and the other two pins 430 far from the axle post 427 are contacted with different second conducting pieces 452. Upon rotation of the rotating shaft 421, the base 420 of the shaft member 42 is rotated with respect to the control panel 4 and the body member 41. As the base 420 is rotated from a first position to a second position, the sustaining structure 425 is disengaged from a first recess 411 and then engaged with a second recess 411. In other words, when the sustaining structure 425 passes across the rib 413, the elastic element 423 is compressed by the rib 413 and moved toward the receiving hole 422. Since the sustaining element 424 has an arch-shaped upper end, the drag force between the sustaining structure 425 and the rib 413 is decreased. As such, the sustaining structure 425 can be smoothly pass across the rib 413 and then engaged with another recess 414 within the receptacle 410. As the base 420 is rotated from a first position to a second position, the pins 430 of the conducting member 43 are contacted with different second conducting pieces 452 so as to adjust the operating conditions of the washing machine 3. Moreover, since the seal ring 44 is slightly protruded outside the groove 417 after the seal ring 44 is accommodated within the groove 417, the seal ring 44 is effective for filling the gap between the body member 41 and the control panel 4. That is, the use of the seal ring 44 may prevent vapor gas or other foreign substance from entering the junction between the first rotary control switch 40*a* and the control panel 4. As a consequence, the short-circuit problem of the conducting member 43 or the control panel 4 will be avoided.

Figure 5:
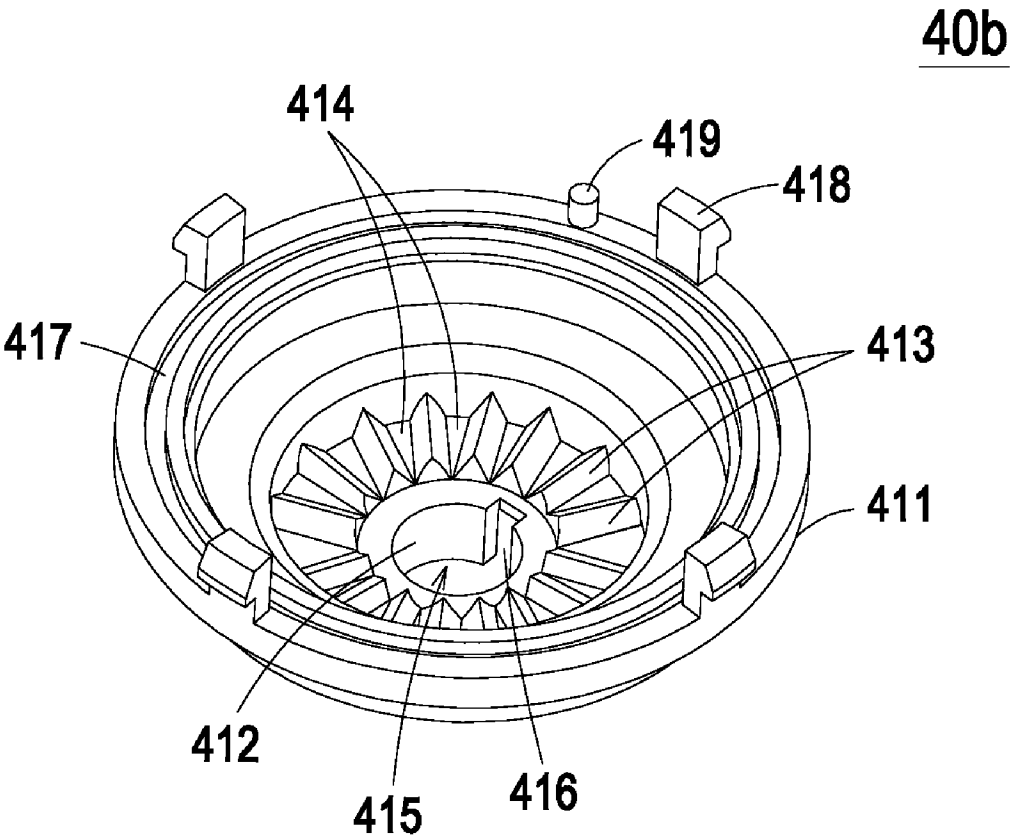
FIG. 5 is a schematic rear view illustrating the body member of the second rotary control switch of FIG. 3.

The configurations of the second rotary control switch 40*b* and the third rotary control switch 40*c* are identical to the configuration of the first rotary control switch 40*a*, and are not redundantly described herein. Corresponding to the second conducting region 45*b* and the third conducting region 45*c* of the control panel 4, the numbers of the recesses 414 and the ribs 413 may be varied according to the practical requirements. For example, as shown in FIG. 3, the contact pads 450 of the second conducting region 45*b* include a first conducting piece 451 and sixteen second conducting pieces 452. In other words, sixteen ribs 413 and sixteen recesses 414 are alternately arranged on the top surface of the first receiving part 4101 of the receptacle 410 (as shown in FIG. 5). As the base 420 of the second rotary control switch 40*b* is rotated from a first position to a second position, the pins 430 of the conducting member 43 are contacted with different second conducting pieces 452 so as to adjust the operating conditions of the washing machine 3.

For preventing from erroneously mounting the second rotary control switch 40*b* on the first conducting region 45*a*, the positioning element 419 of the second rotary control switch 40*b* is distinguished from the positioning element 419 of the first rotary control switch 40*a*. In addition, corresponding to the positioning element 419 of the second rotary control switch 40*b*, a positioning hole 48 is formed in the vicinity of the second conducting region 45*b* of the control panel 4. The positioning hole 48 formed in the vicinity of the second conducting region 45*b* is distinguished from the positioning hole 48 formed in the vicinity of the first conducting region 45*a*. The positioning element 419 is inserted into the corresponding positioning hole 48 to facilitate positioning the body member 41 on the conducting region 45 of the control panel 4. As a consequence, the first rotary control switch 40*a* and the second rotary control switch 40*b* can be accurately mounted on the first conducting region 45*a* and the second conducting region 45*b* in a foolproof manner, thereby avoiding the erroneous mounting.

Figure 6A:
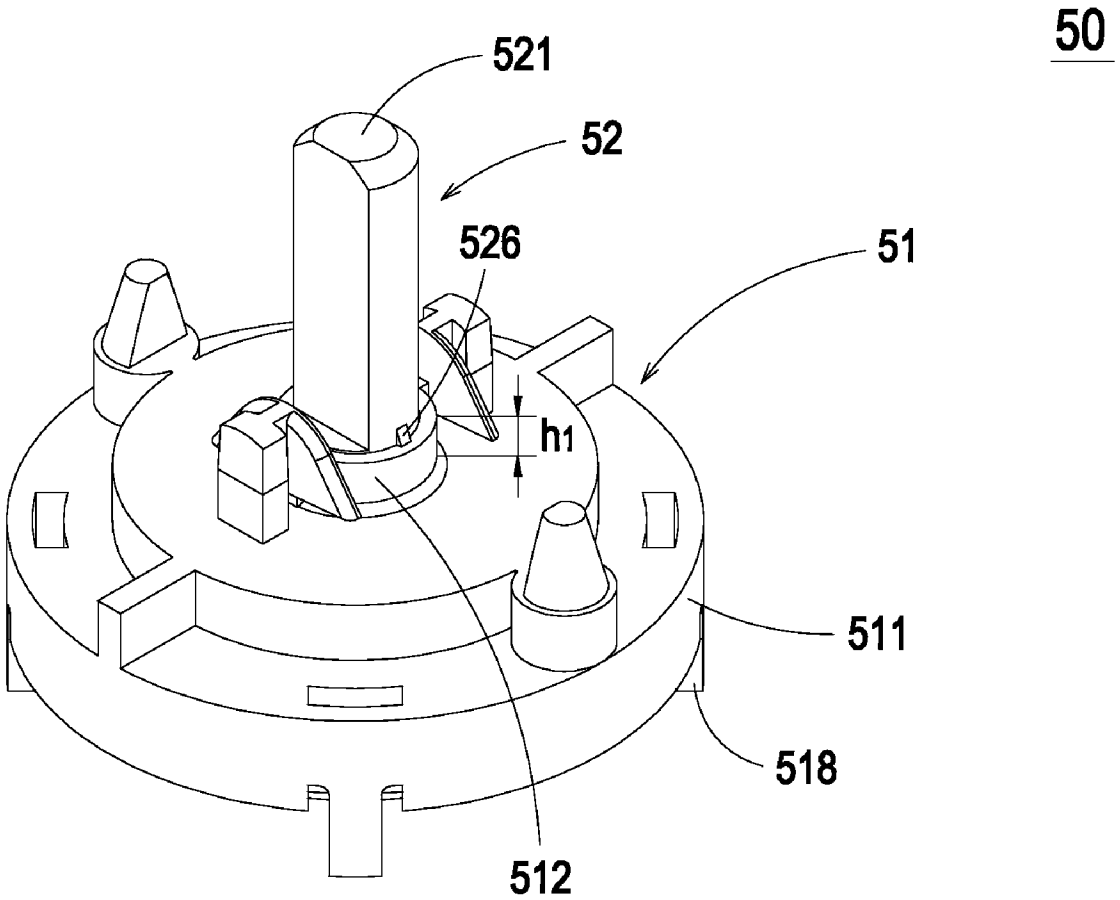
FIG. 6A is a schematic assembled view of a rotary control switch according to another embodiment of the present invention.
Figure 6B:
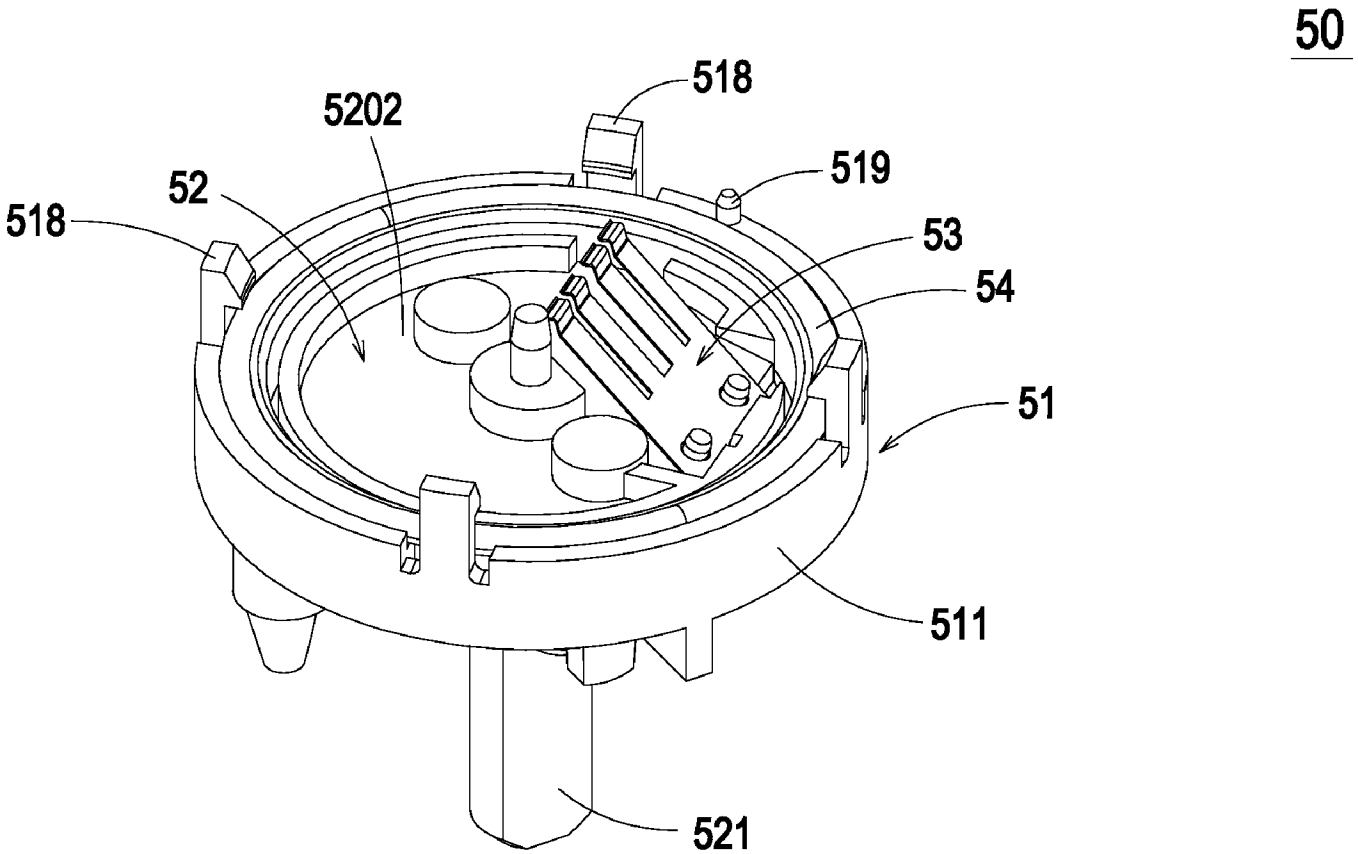
FIG. 6B is a schematic rear view of the rotary control switch as shown in FIG. 6A.
Figure 6C:
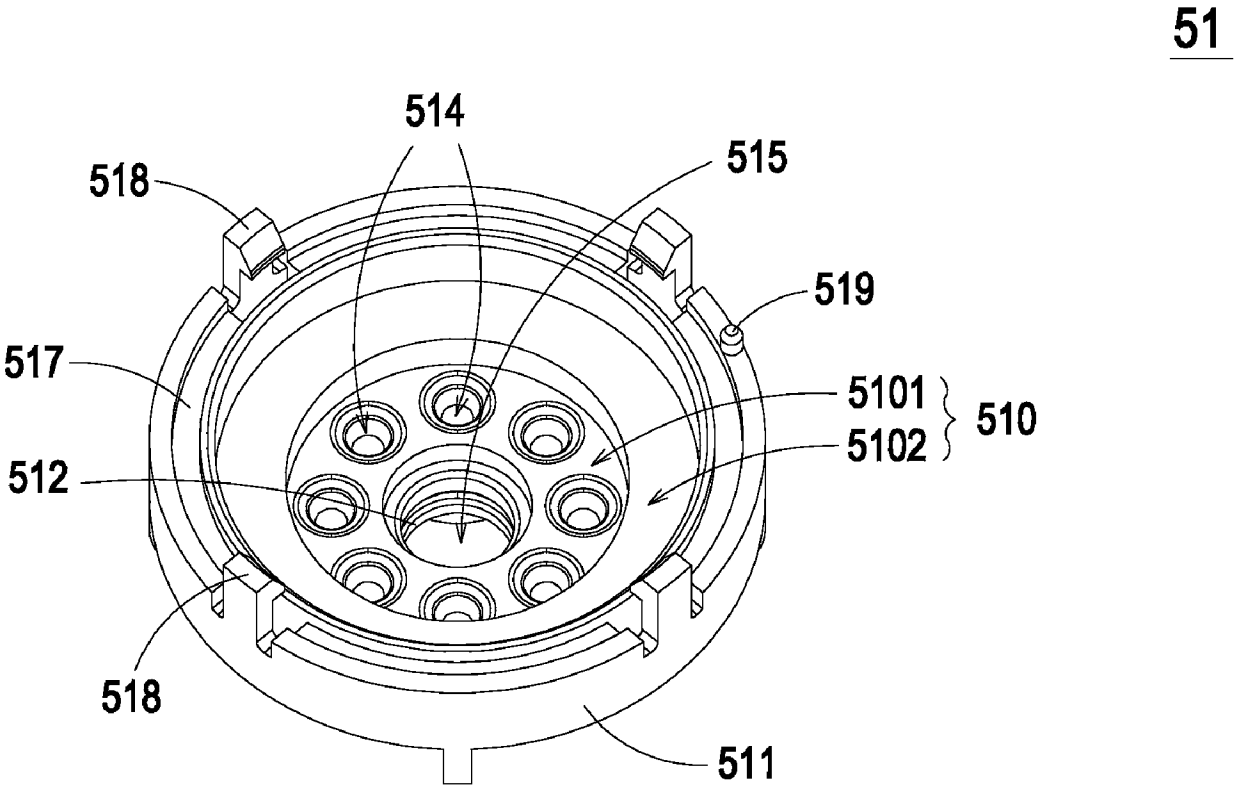
FIG. 6C is a schematic rear view illustrating the body member of the rotary control switch as shown in FIG. 6A.

FIG. 6A is a schematic assembled view of a rotary control switch according to another embodiment of the present invention. FIG. 6B is a schematic rear view of the rotary control switch as shown in FIG. 6A. FIG. 6C is a schematic rear view illustrating the body member of the rotary control switch as shown in FIG. 6A. Please refer to FIGS. 6A, 6B and 6C. The rotary control switch 50 includes a body member 51, a shaft member 52, a conducting member 53 and a seal ring 54. The body member 51 includes a disc-shaped main body 511. A receptacle 510 is defined at the rear side of the body member 51 (as shown in FIG. 6C). The receptacle 510 includes a first receiving part 5101 and a second receiving part 5102. The configurations of the first receiving part 5101 and the second receiving part 5102 are substantially identical to those shown in FIG. 4B, and are not redundantly described herein. In addition, several recesses 514 are formed in the receptacle 510. In particular, eight recesses 514 are arranged in the top surface of the first receiving part 5101 of the receptacle 510.

Moreover, the body member 51 further includes a perforation 515 and a sleeve 512. The sleeve 512 has a height h1 and is communicated with the receptacle 510 through the perforation 515. The sleeve 512 is also vertically protruded from the top surface of the main body 511 of the body member 51. In comparison with FIG. 4A, the sleeve 512 has no notch. The configurations of the groove 517, the engaging elements 518 and the positioning element 519 of the body member 51 are substantially identical to those shown in FIG. 4B, and are not redundantly described herein.

Figure 6D:
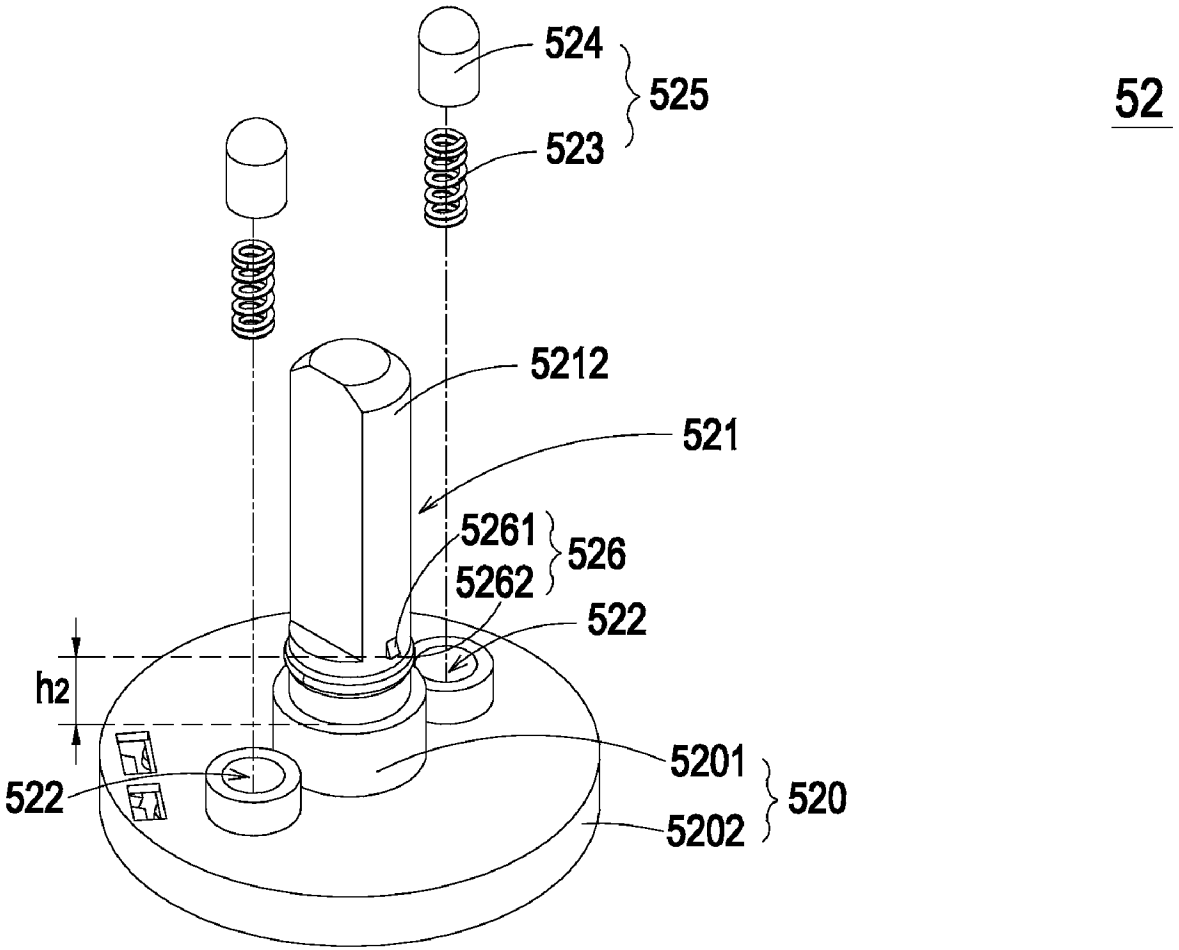
FIG. 6D is a schematic perspective view illustrating the shaft member of the rotary control switch as shown in FIG. 6A.

FIG. 6D is a schematic perspective view illustrating the shaft member of the rotary control switch as shown in FIG. 6A. As shown in FIG. 6D, the shaft member 52 includes a base 520, a rotating shaft 521, several sustaining structures 525 and a protrusion 526. The base 520 includes a first base segment 5201 and a second base segment 5202. The configurations of the first base segment 5201, the second base segment 5202 and the rotating shaft 521 are substantially identical to those shown in FIG. 4A, and are not redundantly described herein. The sustaining structure 525 is collectively defined by a resilient element 523 and a sustaining element 524. In this embodiment, the shaft member 52 includes two sustaining structures 525. Corresponding to the sustaining structures 525, two receiving holes 522 are formed in the base 520 and parallel with the rotating shaft 521 for respectively receiving therein the sustaining structures 525. It is noted that the number of the sustaining structure 525 and the receiving holes 522 may be varied according to the practical requirements.

Please refer to FIG. 6D. A protrusion 526 is formed on the rotating shaft 521 of the shaft member 52. Preferably, the protrusion 526 is integrally extended from a curved surface 5212 of the rotating shaft 521. In this embodiment, the protrusion 526 includes a slant 5261 and a sustaining surface 5262. The slant 5261 is extended from the rotating shaft 521 toward the base 520. The sustaining surface 5262 is connected to the lower edge of the slant 5261 and substantially perpendicular to the rotating shaft 521. In other words, the protrusion 526 is substantially a triangular prism formed on the curved surface 5212 of the rotating shaft 521. The slant 5261 is descended from top to bottom. Similarly, the protrusion 526 is distant from the first base segment 5201 by a gap h2.

The relation between the conducting member 53 and the seal ring 54 and the relation between the shaft member 52 and the body member 51 are identical to those illustrated in the first embodiment, and are not redundantly described herein. During the rotating shaft 521 is penetrated through the perforation 515, the slant 5261 of the protrusion 526 is sustained against the junction between the sleeve 512 and the receptacle 510. In addition, the gap h2 between the protrusion 526 and the first base segment 5201 is slightly greater than the height h1 of the sleeve 512. After the protrusion 526 is moved across the sleeve 512, the sustaining surface 5262 of the protrusion 526 is sustained against the sleeve 512 of the main body 511. That is, the elastic force exerted on the top surface of the receptacle 510 by the sustaining structure 525 is balanced when the protrusion 526 and the sleeve 512 are sustained against each other. Under this circumstance, the shaft member 52 and the body member 51 are securely combined together and the base 520 of the shaft member 52 is smoothly accommodated within the receptacle 510 of the body member 51.

After the rotary control switch 50 is mounted on the control panel 4, the base 520 is rotated upon rotation of the rotating shaft 521. As the base 520 is rotated from a first position to a second position, the pins 530 of the conducting member 53 are contacted with different second conducting pieces 452 so as to adjust the operating conditions of the washing machine 3.

Figure 7A:
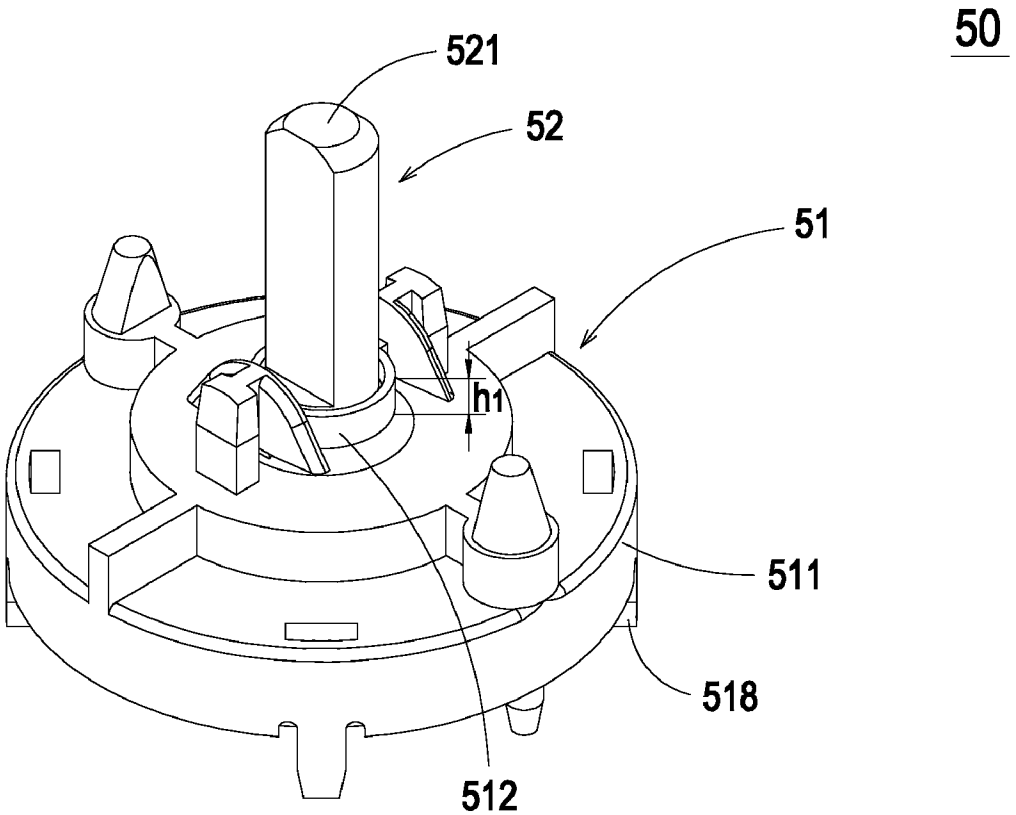
FIG. 7A is a schematic assembled view of a rotary control switch according to another embodiment of the present invention.
Figure 7B:
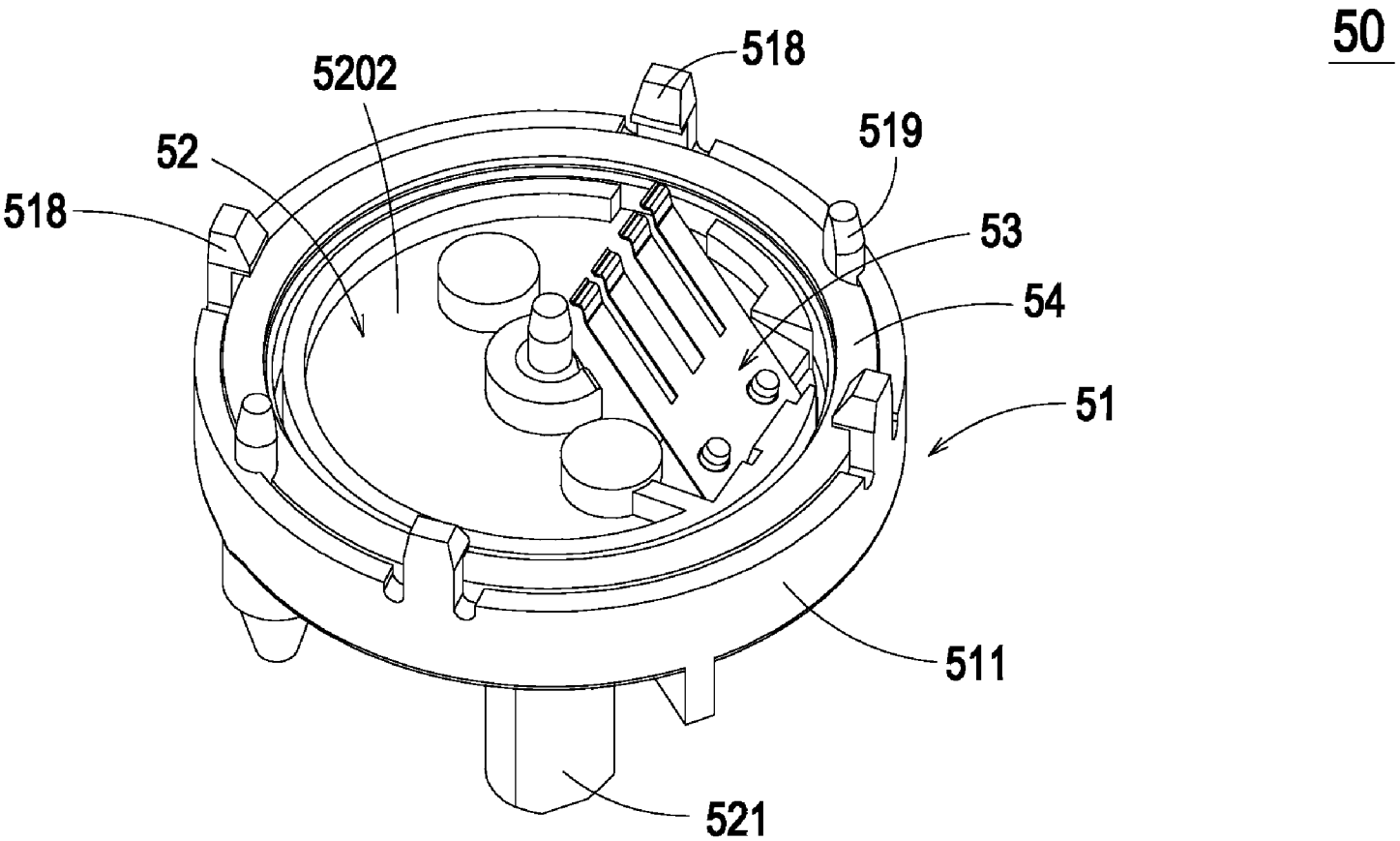
FIG. 7B is a schematic rear view of the rotary control switch as shown in FIG. 7A.
Figure 7C:
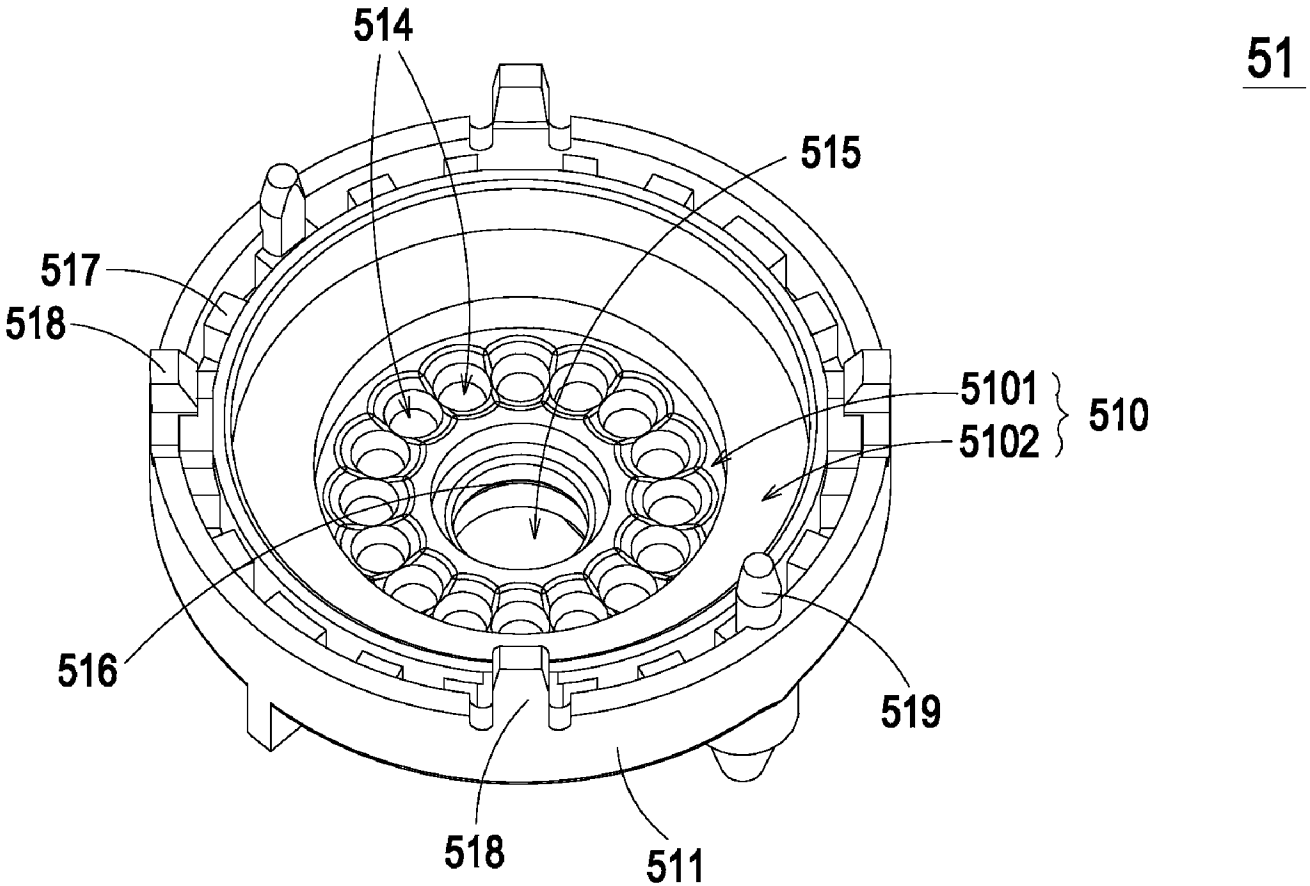
FIG. 7C is a schematic rear view illustrating the body member of the rotary control switch as shown in FIG. 7A.

FIG. 7A is a schematic assembled view of a rotary control switch according to another embodiment of the present invention. FIG. 7B is a schematic rear view of the rotary control switch as shown in FIG. 7A. FIG. 7C is a schematic rear view illustrating the body member of the rotary control switch as shown in FIG. 7A. Please refer to FIGS. 7A, 7B and 7C. The rotary control switch 50 includes a body member 51, a shaft member 52, a conducting member 53 and a seal ring 54. The body member 51 includes a disc-shaped main body 511. A receptacle 510 is defined at the rear side of the body member 51 (as shown in FIG. 7C). The receptacle 510 includes a first receiving part 5101 and a second receiving part 5102. The configurations of the first receiving part 5101 and the second receiving part 5102 are substantially identical to those shown in FIGS. 6A and 6B, and are not redundantly described herein. In addition, several recesses 514 are formed in the receptacle 510. In particular, sixteen or eight recesses 514 are arranged in the top surface of the first receiving part 5101 of the receptacle 510.

Moreover, the body member 51 further includes a perforation 515 and a sleeve 512. The sleeve 512 has a height h1 and is communicated with the receptacle 510 through the perforation 515. The sleeve 512 is also vertically protruded from the top surface of the main body 511 of the body member 51. In comparison with FIG. 4A, the sleeve 512 has no notch. The configurations of the groove 517, the engaging elements 518 and the positioning element 519 of the body member 51 are substantially identical to those shown in FIG. 6C, and are not redundantly described herein. In an embodiment, the body member 51 includes an engaging slot 516 formed on and disposed around an inner surface of the sleeve 512.

Figure 7D:
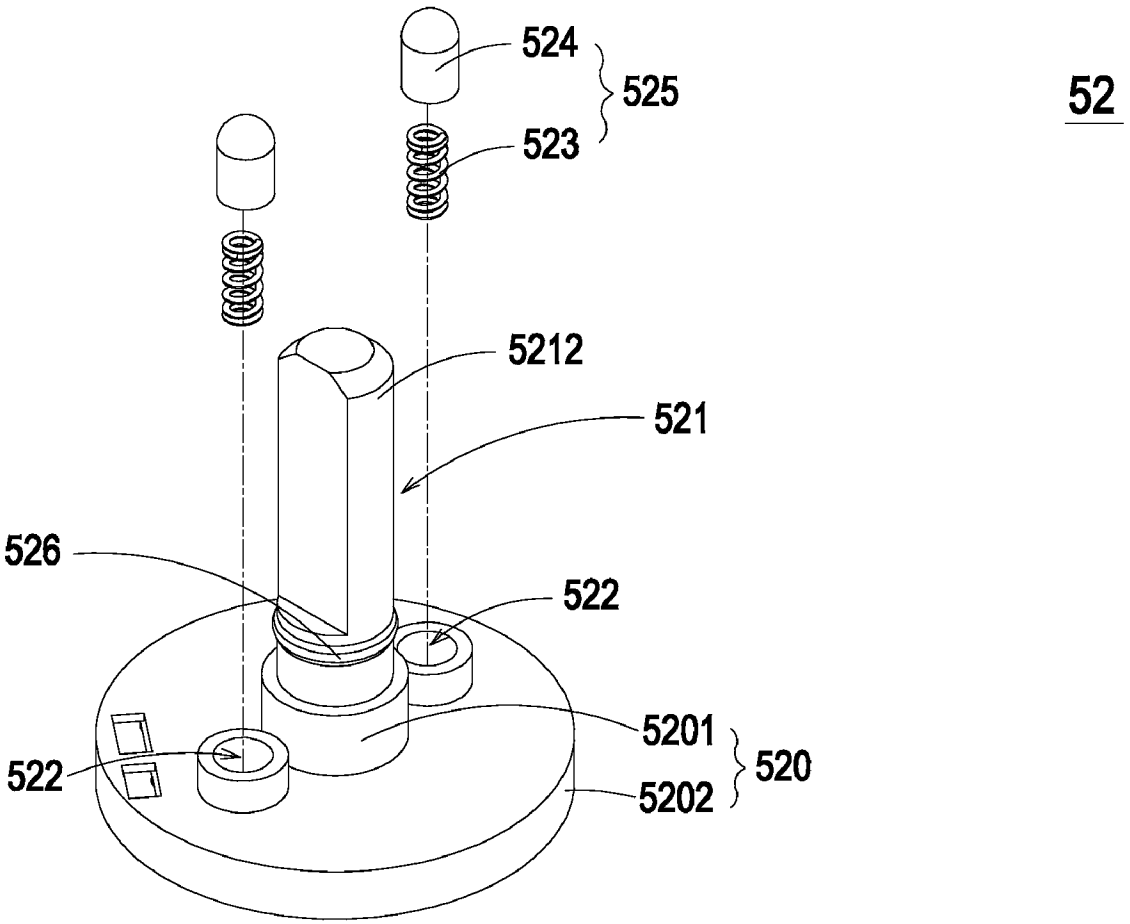
FIG. 7D is a schematic perspective view illustrating the shaft member of the rotary control switch as shown in FIG. 7A.

FIG. 7D is a schematic perspective view illustrating the shaft member of the rotary control switch as shown in FIG. 7A. As shown in FIG. 7D, the shaft member 52 includes a base 520, a rotating shaft 521, several sustaining structures 525 and a protrusion 526. The base 520 includes a first base segment 5201 and a second base segment 5202. The configurations of the first base segment 5201, the second base segment 5202 and the rotating shaft 521 are substantially identical to those shown in FIG. 6D, and are not redundantly described herein. The sustaining structure 525 is collectively defined by a resilient element 523 and a sustaining element 524. In this embodiment, the shaft member 52 includes two sustaining structures 525. Corresponding to the sustaining structures 525, two receiving holes 522 are formed in the base 520 and parallel with the rotating shaft 521 for respectively receiving therein the sustaining structures 525. It is noted that the number of the sustaining structure 525 and the receiving holes 522 may be varied according to the practical requirements.

Please refer to FIG. 7D. A protrusion 526 is formed on the rotating shaft 521 of the shaft member 52. Preferably, the protrusion 526 is integrally extended from a curved surface 5212 of the rotating shaft 521 adjacent to the first base segment 5201. In this embodiment, the protrusion 526 is a raised ring protruded from the curved surface 5212 of the rotating shaft 521 adjacent to the first base segment 5201. The protrusion 526 of the rotating shaft 521 is aligned and mated with the engaging slot 516 formed on the inner surface of the sleeve 512 of the body member 51.

The relation between the conducting member 53 and the seal ring 54 and the relation between the shaft member 52 and the body member 51 are identical to those illustrated in the second embodiment (as shown in FIGS. 6A~6D), and are not redundantly described herein. During the rotating shaft 521 is penetrated through the perforation 515, the protrusion 526 of the rotating shaft 521 is aligned and engaged with the engaging slot 516 formed on the inner surface of the sleeve 512 of the body member 51 so that the elastic force exerted on the top surface of the receptacle 510 by the sustaining structure 525 is balanced. Under this circumstance, the shaft member 52 and the body member 51 are securely combined together and the base 520 of the shaft member 52 is smoothly accommodated within the receptacle 510 of the body member 51. In addition, the protrusion 526 of the rotating shaft 521 engaged with the engaging slot 516 formed on the inner surface of the sleeve 512 can also provide waterproof function.

After the rotary control switch 50 is mounted on the control panel 4, the base 520 is rotated upon rotation of the rotating shaft 521. As the base 520 is rotated from a first position to a second position, the pins 530 of the conducting member 53 are contacted with different second conducting pieces 452 so as to adjust the operating conditions of the washing machine 3.

Moreover, different conducting region 45 may have different numbers of second conducting pieces 452. For example, the contact pads 450 of the conducting region 45 may include a first conducting piece 451 and sixteen second conducting pieces 452. Under this circumstance, sixteen recesses 514 are arranged on the top surface of the first receiving part 5101 of the receptacle 510 at regular intervals.

It is noted that, however, those skilled in the art will readily observe that numerous modifications and alterations may be made while retaining the teachings of the invention. For example, the rotary control switch may be fixed on the control panel by adhering means. In addition, the numbers of the engaging elements of the first and second rotary control switches are different; and the numbers of the engaging holes corresponding to the first and second rotary control switches are different. As such, the engagement between the engaging elements of the rotary control switch and the corresponding engaging holes can achieve the foolproof purpose without the need of arranging the positioning hole. In some embodiments, for preventing from erroneously mounting the rotary control switch, the sizes of the engaging elements of the first and second rotary control switches; and the sizes of the engaging holes corresponding to the first and second rotary control switches are different. In other words, the engaging element and the positioning element of the rotary control switch and the engaging hole and the positioning hole of the control panel are modified and varied as required.

From the above embodiment, after the protrusion of the shaft member is penetrated through the sleeve of the body member and sustained against the sleeve, the base of the shaft member is well accommodated within the receptacle of the body member, and the shaft member and the body member are securely combined together without the need of using the plastic tube. Moreover, since the recesses are arranged in the top surface of the receptacle and the sustaining structure is arranged along the extending direction of the rotating shaft, the procedure of using the sharp tool is omitted to simplify the process of assembling the rotary control switch. Since the seal ring is slightly protruded outside the groove after the seal ring is accommodated within the groove, the seal ring is effective for filling the gap between the body member and the control panel without the need of using the waterproof glue. In other words, the process of assembling the rotary control switch of the present invention is very simple.

During the rotary control switch is mounted on the conducting region of the control panel, the positioning element of the body member is inserted into the positioning hole in order to facilitate alignment of the body member on the control panel. Due to the engagement between the engaging elements of the rotary control switch and the corresponding engaging holes, the rotary control switch is securely fixed on the conducting region of the control panel. As a consequence, the area of the body member is reduced and the space utilization of the control panel is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A rotary control switch mounted on a control panel of an electrical appliance, said rotary control switch comprising:

a body member comprising a main body having a receptacle and a perforation, wherein multiple recesses are disposed within said receptacle, and said perforation is communicated with said receptacle;

a shaft member comprising a base and a rotating shaft, wherein said base is aligned with said receptacle of said body member, said base has a sustaining structure, and a protrusion is extended from said rotating shaft; and a conducting member connected with said base of said shaft member, wherein after said rotating shaft of said shaft member is penetrated through said perforation of said body member and protruded from said body member, said protrusion is sustained against or engaged with said main body and said base is accommodated within said receptacle of said body member, wherein said main body of said body member is disposed on said control panel, and said base of said shaft member is rotated with respect to said control panel and said body member upon rotation of said rotating shaft, and wherein when said sustaining structure is sustained against a specified one of said recesses, said conducting member is electrically connected with a corresponding contact pad of said control panel.

2. The rotary control switch according to claim 1 wherein said recesses are arranged on a top surface of said receptacle of said main body.

3. The rotary control switch according to claim 2 wherein said recesses are concavely formed on said top surface of said receptacle of said main body.

4. The rotary control switch according to claim 2 wherein multiple ribs are formed on said top surface of said receptacle of said main body, and each recess is collectively defined by every two adjacent ribs.

5. The rotary control switch according to claim 2 wherein said rotating shaft of said shaft member is substantially perpendicular to said base, and said shaft member further includes a receiving hole parallel with said rotating shaft for partially accommodating said sustaining structure, so that said sustaining structure is parallel with said rotating shaft and engaged with one of said recesses of said body member.

6. The rotary control switch according to claim 1 wherein said main body of said body member has a groove formed in a surface facing said control panel, and said rotary control switch further includes a seal ring accommodated within said groove.

7. The rotary control switch according to claim 1 wherein an engaging hole is formed in said control panel, and an engaging element is extended from said main body of said body member, wherein said engaging element is engaged with said engaging hole such that said body member is fixed on said control panel.

8. The rotary control switch according to claim 1 wherein a positioning hole is formed in said control panel, and a positioning element is extended from said main body of said body member, wherein said positioning element is inserted into said positioning hole for facilitating positioning said body member.

9. The rotary control switch according to claim 1 wherein a sleeve is extended from said main body of said body member, and said sleeve is communicated with said receptacle through said perforation.

10. The rotary control switch according to claim 9 wherein said sleeve has a notch, said protrusion of said shaft member is moved along said notch during said rotating shaft is penetrated through said perforation, and said protrusion is sustained against said sleeve when said protrusion is not aligned with said notch by rotating said rotating shaft.

11. The rotary control switch according to claim 9 wherein said protrusion has a slant, and said slant of said protrusion is sustained against said sleeve when said protrusion is not aligned with said notch by rotating said rotating shaft.

12. The rotary control switch according to claim 9 wherein said sleeve has an engaging slot formed on an inner surface thereof, and when said rotating shaft is penetrated through said perforation, said protrusion of said rotating shaft is aligned and engaged with said engaging slot formed on said inner surface of said sleeve.

13. A control panel of an electrical appliance, said control panel comprising:

a conducting region having multiple contact pads; and a rotary control switch mounted on said conducting region, and comprising:

a body member comprising a main body having a receptacle and a perforation, wherein multiple recesses are disposed within said receptacle, and said perforation is communicated with said receptacle;

a shaft member comprising a base and a rotating shaft, wherein said base is aligned with said receptacle of said body member, said base has a sustaining structure, and a protrusion is extended from said rotating shaft; and a conducting member connected with said base of said shaft member, wherein after said rotating shaft of said shaft member is penetrated through said perforation of said body member and protruded from said body member, said protrusion is sustained against or engaged with said main body and said base is accommodated within said receptacle of said body member, wherein said main body of said body member is disposed on said conducting region, and said base of said shaft member is rotated with respect to said control panel and said body member upon rotation of said rotating shaft, and wherein when said sustaining structure is sustained against a specified one of said recesses, said conducting member is electrically connected with a corresponding contact pad of said conducting region.

14. The control panel according to claim 13 wherein said contact pads include a first conducting piece and multiple second conducting pieces, said second conducting pieces are discretely arranged around the periphery of said first conducting piece, and the number of said second conducting pieces is equal to the number of said recesses of said body member.

15. The control panel according to claim 13 wherein said recesses are arranged on a top surface of said receptacle of said main body, said rotating shaft of said shaft member is substantially perpendicular to said base, and said shaft member further includes a receiving hole parallel with said rotating shaft for partially accommodating said sustaining structure, so that said sustaining structure is parallel with said rotating shaft and engaged with one of said recesses of said body member.

16. The control panel according to claim 13 wherein said main body of said body member has a groove formed in a surface facing said control panel, and said rotary control switch further includes a seal ring accommodated within said groove.

17. The control panel according to claim 13 wherein an engaging hole is formed in said control panel, and an engaging element is extended from said main body of said body member, wherein said engaging element is engaged with said engaging hole such that said body member is fixed on said conducting region of said control panel.

18. The control panel according to claim 13 wherein a positioning hole is formed in said control panel, and a positioning element is extended from said main body of said body member, wherein said positioning element is inserted into said positioning hole for facilitating positioning said body member.

19. The control panel according to claim 13 wherein a sleeve is extended from said main body of said body member, and said sleeve is communicated with said receptacle through said perforation.

20. The control panel according to claim 19 wherein said sleeve has a notch, said protrusion of said shaft member is moved along said notch during said rotating shaft is penetrated through said perforation, and said protrusion is sustained against said sleeve when said protrusion is not aligned with said notch by rotating said rotating shaft.

21. The control panel according to claim 19 wherein said protrusion has a slant, and said slant of said protrusion is sustained against said sleeve when said protrusion is not aligned with said notch by rotating said rotating shaft.

22. The control panel according to claim 19 wherein said sleeve has an engaging slot formed on an inner surface thereof, and when said rotating shaft is penetrated through said perforation, said protrusion of said rotating shaft is aligned and engaged with said engaging slot formed on said inner surface of said sleeve.

* * * * *